US008087535B1

(12) United States Patent
Blum

(10) Patent No.: US 8,087,535 B1
(45) Date of Patent: Jan. 3, 2012

(54) SERVING DISH WITH DISPENSING RAMPS

(76) Inventor: Alvin S. Blum, Fort Lauderdale, FL (US)

( * ) Notice: Subject to any disclaimer, the term of this patent is extended or adjusted under 35 U.S.C. 154(b) by 1054 days.

(21) Appl. No.: 11/803,658

(22) Filed: May 15, 2007

Related U.S. Application Data

(60) Provisional application No. 60/900,878, filed on Feb. 12, 2007.

(51) Int. Cl.
*A47G 19/00* (2006.01)
*A47G 19/02* (2006.01)
*B65D 1/34* (2006.01)

(52) U.S. Cl. ..... 220/574.1; 220/571

(58) Field of Classification Search ..... 220/574, 220/574.1, 571, 571.1; 222/571, 572
See application file for complete search history.

(56) References Cited

U.S. PATENT DOCUMENTS 1,886,958 A * 11/1932 Ittem ..... 222/572
2,006,704 A * 7/1935 Van Muffling ..... 222/173
2,271,822 A * 2/1942 Hills ..... 222/572
2,543,452 A * 2/1951 Flinchbaugh ..... 222/465.1
5,351,931 A * 10/1994 Houben et al. ..... 249/141
6,047,845 A 4/2000 Rapaz
D473,418 S * 4/2003 Burton et al. ..... D7/354
6,814,235 B2 11/2004 Wang
D499,304 S * 12/2004 Wiedmeyer et al. ..... D7/549
2001/0050285 A1 12/2001 Morris
2005/0115974 A1 6/2005 Micciulla

* cited by examiner

*Primary Examiner* — Bryon Gehman
*Assistant Examiner* — Shawn Braden
(74) *Attorney, Agent, or Firm* — Alvin S. Blum

(57) ABSTRACT

A serving receptacle dispenses food therefrom onto a diner's plate while overcoming the problem of food being dropped onto the table during dispensing. At least one dispensing ramp is coextensive with the serving dish upper surface and extends upward and horizontally over the edge of a diner's plate. Each ramp has two opposed side edges that extend upwardly from the ramp surface to reduce the chances of food or fluid dropping off the ramp during dispensing. The food is moved onto the ramp and then past the leading edge of the ramp, where it will then fall onto the diner's plate. There may be two opposed ramps that also serve as handles. The ramps have an upper surface that is slightly sloped upwardly as it approaches the outer edge of the ramp. This enables liquids to flow back into the dish instead of dripping over the edge. A drip projection under the free edge of the ramp causes liquid at the edge to drip down onto the plate.

5 Claims, 3 Drawing Sheets

FIG. 6
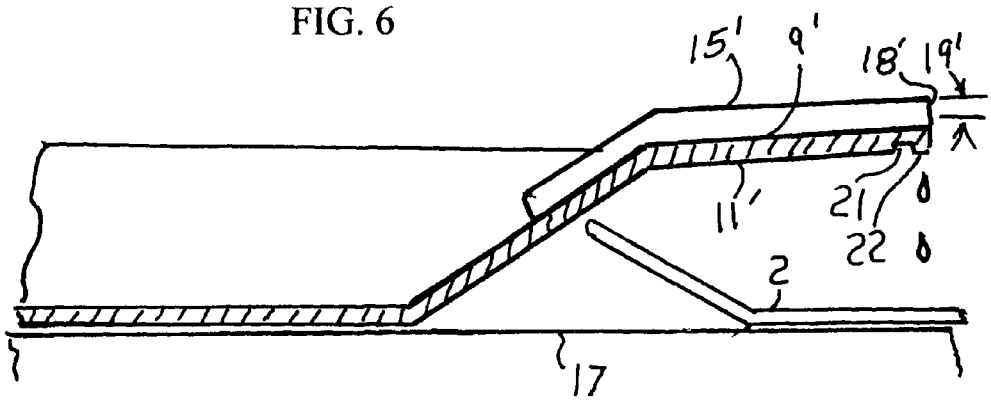
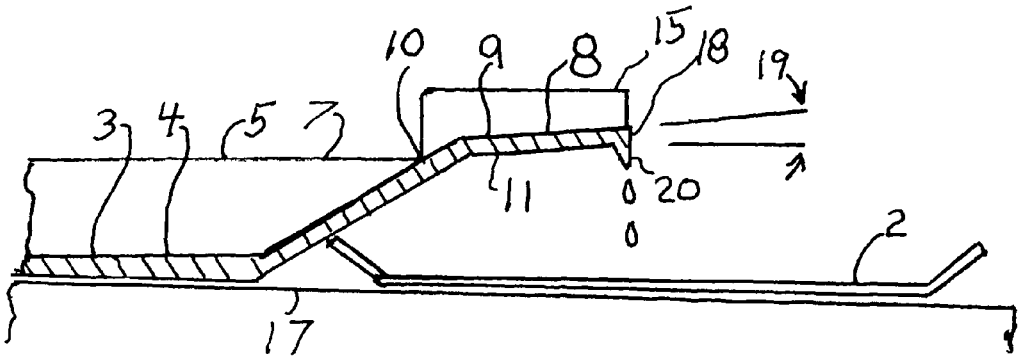
FIG. 5

SERVING DISH WITH DISPENSING RAMPS

This application claims the priority of provisional application for patent Ser. No. 60/900,878 filed Feb. 12, 2007, incorporated herein by reference in its entirety.

FIELD OF THE INVENTION

This invention relates to food service, and more particularly to serving receptacles, dishes, or platters supplied with food that are on a dinning table to present food to individual diners to be removed from the serving dish to the plates of the diners.

BACKGROUND OF THE INVENTION

It is well known in the art to provide a serving dish with a supply of food to be dispensed from there onto the plates of individual diners. In dispensing food from the serving dish, it is not uncommon for a diner to inadvertently spill or drop some of the food onto the table. This may soil a table or tablecloth. It may result in the contamination or loss of food. In some situations, a diner will lift the serving dish partially over his plate, and then slide the food from one to the other to avoid a mishap. This may not be possible or comfortable for some individuals.

SUMMARY OF THE INVENTION

It is accordingly an object of the invention to provide a serving receptacle with a means for dispensing the food therefrom onto a diner's plate that will overcome the problem of food being dropped onto the table during the dispensing process. The serving dish of the invention has at least one dispensing ramp that is coextensive with the serving dish upper surface and extends upward and substantially horizontally over the edge of the usual diner's plate when the serving dish and diner's plate are positioned so that the rim of the diner's plate is beneath the ramp. Each ramp has two opposed side edges that extend upwardly from the ramp surface to reduce the chances of fluid dripping off the ramp during the dispensing operation. The food is then moved onto the ramp and then past the leading edge of the ramp, where it will then fall onto the diner's plate. The serving dish may be supplied with one or more such ramps. In a preferred embodiment, there are two opposed ramps that also may serve as handles. The ramps may preferably have an upper surface that is slightly sloped upwardly as it approaches the outer edge of the ramp. This enables liquids to flow back into the dish instead of dripping over the edge. They may be on the long side or the short side if the dish. The serving dish may have a deep center portion as in a bowl, if desired. In a preferred embodiment, a drip projection under the free edge of the ramp causes liquid at the edge to drip down onto the plate. These and other objects, features, and advantages of the invention will become more apparent from the detailed description of exemplary embodiments thereof as illustrated in the accompanying drawings, in which like elements are designated by like reference characters in the various drawing figures.

BRIEF DESCRIPTION OF THE DRAWINGS

FIG. 5 is a sectional detail of the ramp portion of FIG. 1.

FIG. 6 is a sectional detail of the ramp portion of FIG. 3.

DETAILED DESCRIPTION OF PREFERRED EMBODIMENTS

Figures 1, 2:
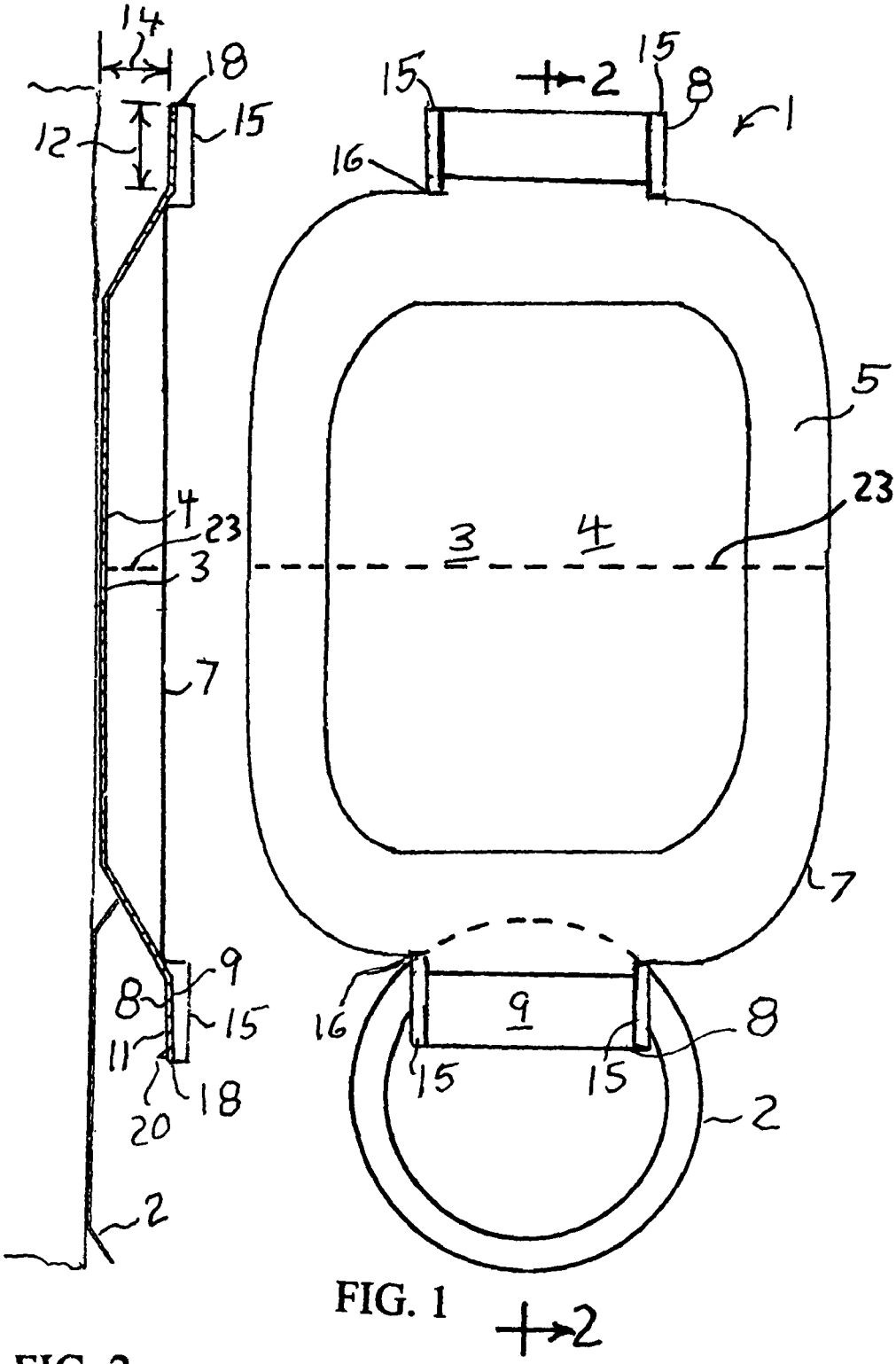
FIG. 1 is a top view of a serving dish of the invention.
FIG. 2 is a sectional view through line 2-2 of FIG. 1.

Referring now first to the drawing FIGS. 1, 2 and 5, a serving dish 1 of the invention has a major central portion 3 constructed to receive and hold food on an upper surface 4. A rim 5 encircles the central portion and extends upwardly and outwardly from the central portion, and terminates in an outer edge 7. A dispensing ramp 8 is disposed at each of the opposed ends 16 of the dish. These ramps may serve as handles when carrying the dish 1. Each ramp 8 has an upper surface 9 with an inner edge 10 that is contiguous with the rim 5 at the outer edge 7 of the rim to enable food to slide easily from the central portion, over the rim, and onto the ramp. The ramp has a lower surface 11 that extends substantially horizontally away from the rim a distance 12 of at least 25 millimeters. The lower surface 11 is elevated a distance 14 above a support surface 17 of at least 25 millimeters to enable most diner's plates 2 to slide under the ramp far enough to enable the outer edge 18 of the ramp to extend over the dish 2 far enough so that food on the ramp will drop onto the plate 2 and not on the support surface when it leaves the ramp. The ramp 8 is provided with two opposed side edges 15 that extend upwardly from the ramp surface 9 to reduce the chances of fluid dripping off the ramp during the dispensing operation when food is being dispensed from the dish 1 onto the diner's plate. The upper surface 9 of each ramp slopes upwardly to the ramp outer edge 18 at an angle 19 to the horizontal of about 3 degrees so that liquid will tend to return to the center 3. The lower surface 11 of the ramp is provided with a drip projection 20 that forces liquid that flows past the edge 18 to drip from the projection rather than flow down the underside of the ramp and then onto the support surface 17. The drip projection also enhances the use of the ramps as carrying handles. A raised partition 23 (shown in phantom) may be optionally provided to divide the serving dish into two compartments to serve two different foods.

Figure 3:
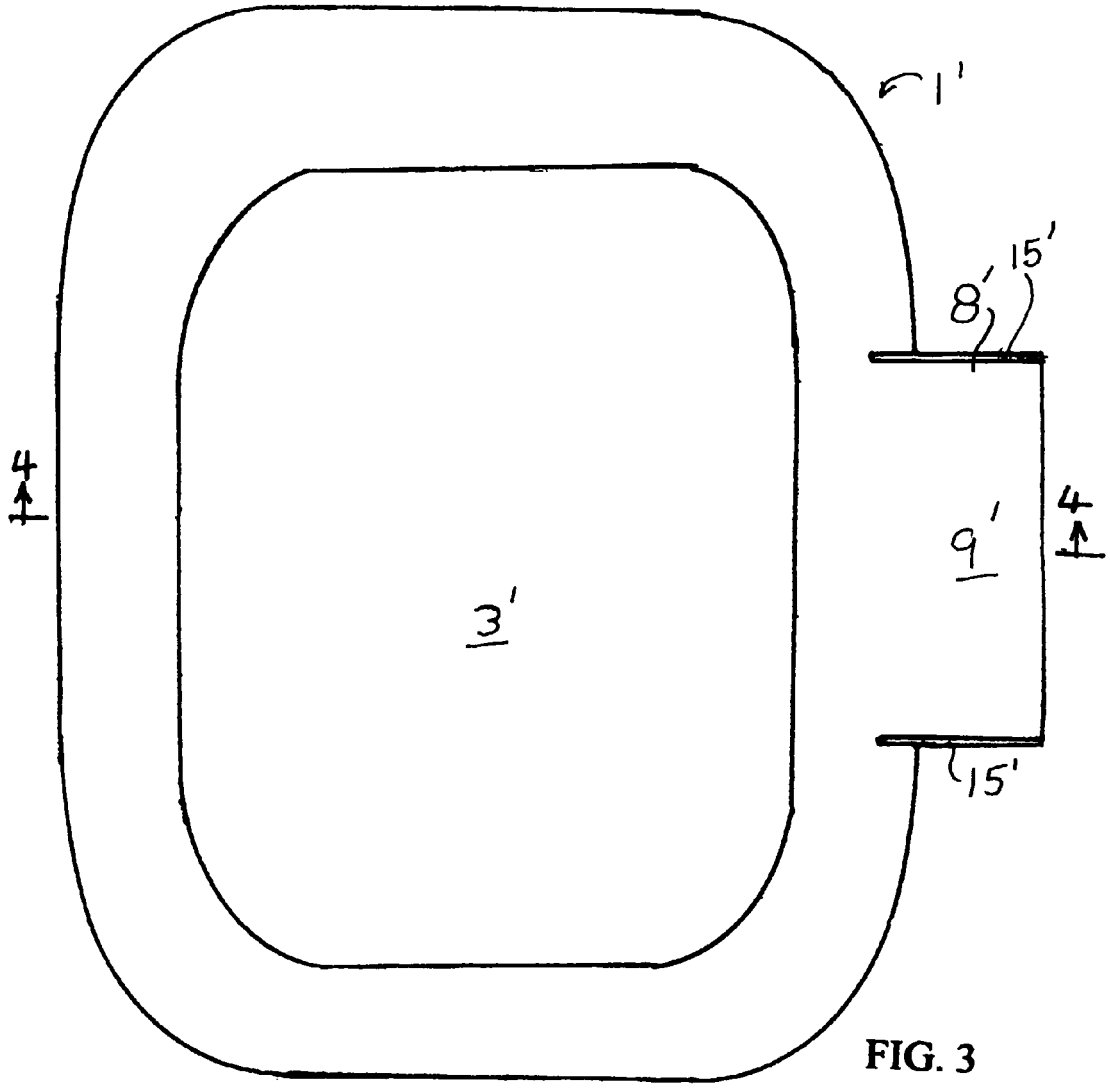
FIG. 3 is a top view of another embodiment of the invention.
Figure 4:
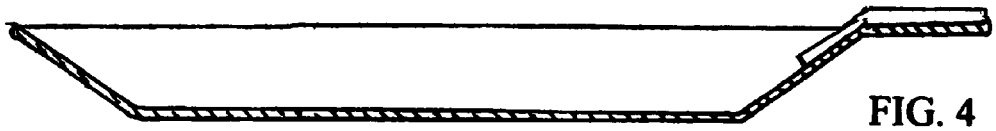
FIG. 4 is a sectional view through line 4-4 of FIG. 3

Referring now to FIGS. 3,4 and 6, another embodiment of the invention is shown in which a single ramp 8' is shown on one side of the serving dish 1'. The ramp 8' is provided with two opposed side edges 15' that extend upwardly from the ramp surface 9' to reduce the chances of fluid dripping off the ramp during the dispensing operation when food is being dispensed from the dish 1' onto the diner's plate. The upper surface 9' of each ramp slopes upwardly to the ramp outer edge 18' at an angle 19' to the horizontal of about 5 degrees so that liquid will tend to return to the center 3'. The lower surface 11' of the ramp is provided with a groove 21 that forces liquid that flows past the edge 18' to drip from the effective drip projection 22 onto the plate below rather than flow down the underside of the ramp and then onto the support surface 17. The groove 21 must be large enough to overcome the liquid surface tension that tends to bridge gaps. The lower surface 11' of the ramp is elevated above the support surface 17 an amount sufficient to clear a rim of a diner's dish 2, and it extends horizontally an amount sufficient to position the ramp edge 18' over the diner's dish.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A serving dish constructed for facilitating transfer of food from the serving dish to a diner's plate, the serving dish comprising:

a major central portion constructed to receive and hold food on an upper surface;

a rim encircling the central portion, the rim having an upper surface contiguous with the central portion upper surface and extending upwardly and outwardly therefrom, and terminating in an outer rim edge;

two dispensing ramps at opposite ends of the dish, each dispensing ramp having an upper surface with an inner ramp edge contiguous with the upper surface of the rim at said outer rim edge, and extending away from the outer rim edge;

each dispensing ramp having a lower surface that extends substantially horizontally away from the outer rim edge a distance of at least 25 millimeters, a width of at least 75 millimeters, and elevated at least 25 millimeters above a support surface for supporting the serving dish to thereby provide a clear space between the lower surface and the support surface to receive the diner's plate therebetween;

each ramp having two opposed side edges that extend upwardly from the upper surface to contain food and fluids during their transfer along the ramp;

the upper surface of the each ramp sloping upwardly to the ramp outer edge so that liquids will flow back into the central portion; and a drip projection at the lower surface at the outer ramp edge to cause liquids to drip down.

2. A serving dish constructed for facilitating transfer of food from the serving dish to a diner's plate, the serving dish comprising:

a major central portion constructed to receive and hold food on an upper surface;

a rim encircling the central portion, the rim having an upper surface contiguous with the central portion upper surface and extending upwardly and outwardly therefrom, and terminating in an outer rim edge;

at least one dispensing ramp having an upper surface with an inner ramp edge contiguous with the rim upper surface at said outer rim edge, and extending away from the outer rim edge;

the at least one dispensing ramp having a lower surface that is elevated above a support surface supporting the dish an amount sufficient to clear a diner's plate therebetween and that extends substantially horizontally an amount sufficient to position a ramp outer edge over the diner's plate; and the at least one dispensing ramp having two opposed side edges that extend upwardly from the upper surface to contain food and fluids during their transfer along the ramp.

3. The serving dish according to claim 2 having two dispensing ramps at opposite ends of the dish that also serve as handles for carrying the serving dish to and from the support surface.

4. The serving dish according to claim 3 in which the upper surface of each ramp slopes upwardly to the ramp edge so that liquids will flow back into the central portion, and a drip projection is provided at the lower surface at the ramp edge to cause liquids to drip down.

5. A serving dish constructed for facilitating transfer of food from the serving dish to a diner's plate, the serving dish comprising:

a major central portion constructed to receive and hold food on an upper surface;

a rim encircling the central portion, the rim having an upper surface contiguous with the central portion upper surface and extending upwardly and outwardly therefrom, and terminating in an outer rim edge;

two dispensing ramps at opposite ends of the dish, each having an upper surface with an inner ramp edge contiguous with the upper surface of the rim at said outer rim edge, and extending away from the outer rim edge;

each dispensing ramp having a lower surface that is elevated above a support surface an amount sufficient to clear the diner's plate therebetwen and that extends substantially horizontally an amount sufficient to position a ramp outer edge over the diner's plate;

each ramp having two opposed side edges that extend upwardly from the upper surface to contain food and fluids during their transfer along the ramp;

the upper surface of the each ramp sloping upwardly to the outer ramp edge so that liquids will flow back into the central portion, and a drip projection at the lower surface at the ramp edge to cause liquids to drip down; and a raised partition dividing the major central portion into two separate food compartments.

* * * * *